US005735975A

United States Patent [19]

Lin et al.

[11] Patent Number: 5,735,975

[45] Date of Patent: Apr. 7, 1998

[54] QUINARY METALLIC GLASS ALLOYS

[75] Inventors: Xianghong Lin; William L. Johnson, both of Pasadena, Calif.

[73] Assignee: California Institute of Technology, Pasadena, Calif.

[21] Appl. No.: 604,452

[22] Filed: Feb. 21, 1996

[51] Int. Cl.[6] ..... C22C 45/10

[52] U.S. Cl. ..... 148/403; 148/421; 420/423

[58] Field of Search ..... 148/403, 407, 148/421; 420/422, 423

[56] References Cited

U.S. PATENT DOCUMENTS

| | | | |
|---|---|---|---|
| 5,032,196 | 7/1991 | Masumoto et al. | 148/403 |
| 5,567,532 | 10/1996 | Peker et al. | 420/422 |

OTHER PUBLICATIONS

Akihisa Inoue et al., "Effect of Additional Elements on Glass Transition Behavior and Glass Formation Tendency of Zr–Al–Cu–Ni Alloys", May 18, 1995, pp. 1420–1426, Materials Transactions, JIM, vol. 36, No. 12.

Akihisa Inoue et al., "Preparation of Bulky Amorphous Zr–Al–Co–Ni–Cu Alloys by Copper Mold Casting and Their Thermal and Mechanical Properties", Aug. 26, 1994, pp. 391–398, Materials Transactions, JIM, vol. 36, No. 3.

Akihisa Inoue et al., "Preparation of 16 mm Diameter Rod of Amorphous $Zr_{65}Al_{7.5}Ni_{10}Cu_{17.5}$ Alloy", Aug. 20, 1993, pp. 1234–1237, Materials Transactions, JIM, vol. 34, No. 12.

Akihisa Inoue et al., "Solidification Analyses of Bulky $Zr_{60}Al_{10}Ni_{10}Cu_{15}Pd_5$ Glass Produced by Casting into Wedge–Shape Copper Mold", May 11, 1995, pp. 1276–1281, Materials Transactions, JIM, vol. 36, No. 10.

Akihisa Inoue, "High Strength Bulk Amorphous Alloys with Low Critical Cooling Rates (Overview)", Jan. 18, 1995, pp. 866–875, Materials Transactions, JIM, vol. 36, No. 7.

Akihisa Inoue et al., "Fabrication of Bulky Zr–Based Glassy Alloys by Suction Casting into Copper Mold", Jun. 6, 1995, pp. 1184–1187, Materials Transactions, JIM, vol. 36, No. 9.

*Primary Examiner*—George Wyszomierski

*Attorney, Agent, or Firm*—Christie, Parker & Hale, LLP

[57] ABSTRACT

At least quinary alloys form metallic glass upon cooling below the glass transition temperature at a rate less than $10^3$ K/s. Such alloys comprise zirconium and/or hafnium in the range of 45 to 65 atomic percent, titanium and/or niobium in the range of 4 to 7.5 atomic percent, and aluminum and/or zinc in the range of 5 to 15 atomic percent. The balance of the alloy compositions comprise copper, iron, and cobalt and/or nickel. The composition is constrained such that the atomic percentage of iron is less than 10 percent. Further, the ratio of copper to nickel and/or cobalt is in the range of from 1:2 to 2:1. The alloy composition formula is:

$$(Zr,Hf)_a(Al,Zn)_b(Ti,Nb)_c(Cu_xFe_y(Ni,Co)_z)_d$$

wherein the constraints upon the formula are: a ranges from 45 to 65 atomic percent, b ranges from 5 to 15 atomic percent, c ranges from 4 to 7.5 atomic percent, d comprises the balance, d·y is less than 10 atomic percent, and x/z ranges from 0.5 to 2.

17 Claims, No Drawings

QUINARY METALLIC GLASS ALLOYS

This invention was made with Government support under DE-FG03-86ER45242 awarded by the Department of Energy. The Government has certain rights in the invention.

BACKGROUND

This invention relates to amorphous metallic alloys, commonly referred to metallic glasses, which are formed by solidification of alloy melts by cooling the alloy to a temperature below its glass transition temperature before appreciable nucleation and crystallization has occurred.

Ordinary metals and alloys crystallize when cooled from the liquid phase. It has been found, however, that some metals and alloys can be undercooled and remain as an extremely viscous liquid phase or glass at ambient temperatures when cooled sufficiently rapidly. Cooling rates in the order of $10^4$ to $10^6$ K/sec are typically required. To achieve such rapid cooling rates, a very thin layer (e.g., less than 100 micrometers) or small droplets of molten metal are brought into contact with a conductive substrate maintained at near ambient temperature.

It is desirable that the cooling rate required to suppress crystallization be in the order of from 1 K/s to $10^3$ K/s or even less. Recently, alloys of zirconium and/or titanium, copper and/or nickel, other transition metals and beryllium have been found which form amorphous bodies of substantial thickness. Such alloy compositions are disclosed in U.S. Pat. Nos. 5,288,344 and 5,368,659. The subject matter of these prior patents is hereby incorporated by reference. Providing amorphous alloys without beryllium would be desirable.

SUMMARY OF THE INVENTION

Thus, there is provided in practice of this invention according to a presently preferred embodiment a class of at least quinary alloys which form metallic glass upon cooling below the glass transition temperature at a rate less than $10^3$ K/s. One alloy composition range has been found to form amorphous solids with cooling rates that permit formation of objects with all dimensions being at least one millimeter. In other words, a sheet of such alloy has a thickness of at least one millimeter.

The alloy composition range comprises zirconium and/or hafnium in the range of 45 to 65 atomic percent, titanium and/or niobium in the range of 5 to 7.5 atomic percent, and aluminum and/or zinc in the range of 5 to 15 atomic percent. The balance of the alloy composition comprises a copper, iron, and cobalt and/or nickel. The composition is constrained such that the atomic percentage of iron is less than 10 percent. Further, the ratio of copper to nickel and/or cobalt is in the range of from 1:2 to 2:1. Preferably the titanium (or niobium) content is in excess of 5 atomic percent.

Stated more rigorously, there is an alloy composition formula as follows:

$$(Zr,Hf)_a(Al,Zn)_b(Ti,Nb)_c(Cu_xFe_y(Ni,Co)_z)_d$$

Constraints upon the formula are:

$45<a<65$
$5<b<15$
$5<c<7.5$
$d=100-(a+b+c)$
$dy<10$
$0.5<x/z<2$

This alloy composition may also comprise up to about 4% other transition metals and a total of no more than 2% of other elements.

DETAILED DESCRIPTION

For purposes of this invention, a metallic glass product is defined as a material which contains at least 50% by volume of the glassy or amorphous phase. This is effectively a microscopic mixture of amorphous and crystalline phases and not a condition where one part of a sample is amorphous and another part is crystalline. Glass forming ability can be verified by splat quenching where cooling rates are in the order of $10^6$ K/s. More frequently, materials provided in practice of this invention comprise substantially 100% amorphous phase. For alloys usable for making parts with dimensions larger than micrometers, cooling rates of less than $10^3$ K/s are desirable. Preferably, cooling rates to avoid crystallization are in the range of from 1 to 100 K/sec or lower.

For identifying preferred glass forming alloys, the ability to cast layers at least one millimeter thick has been selected. Compositions where cast layers 0.5 mm thick are glassy are also acceptable. Generally speaking, an order of magnitude difference in thickness represents two orders of magnitude difference in cooling rate. A sample which is amorphous at a thickness of about one millimeter represents a cooling rate of about 500 K/s.

Such cooling rates may be achieved by a broad variety of techniques, such as casting the alloys into cooled copper molds to produce plates, rods, strips or net shape parts of amorphous materials with thicknesses which may be more than one millimeter. An injection mold die casting technique can achieve faster cooling rates in the range of 100 to $2\times10^3$ K/s.

Conventional methods currently in use for casting glass alloys, such as splat quenching for thin foils, single or twin roller melt-spinning, water melt-spinning, or planar flow casting of sheets may also be used. Amorphous or partially amorphous phase alloy buttons can be generated through the use of arc melters. A small sample is melted several times by an electric arc in a water cooled crucible, to achieve homogeneity in the sample. When the arc is discontinued, the sample solidifies as heat is extracted through the crucible.

Cooling in an arc melter is limited by contact of a cooling surface with a single regional surface of the alloy. Therefore, the cooling effect in an arc melter generates a temperature gradient within the alloy composition. Alloy regions close to the cooling surface cool rapidly and alloy regions further from the surface have a lower cooling rate. The result is that alloy regions closest to the cooling surface may be fully amorphous while those furthest away may crystallize. A typical small button (five grams) in an arc melter may have cooling rates in the order of magnitude from about 10 to 100 K/s.

A variety of new glass forming alloys have been identified in practice of this invention. The ranges of alloys suitable for forming glassy or amorphous material can be defined in various ways. Some of the composition ranges are formed into metallic glasses with relatively higher cooling rates, whereas preferred compositions form metallic glasses with appreciably lower cooling rates. The boundaries of the alloy ranges may vary somewhat as different materials are introduced. The boundaries encompass alloys which form a metallic glass when cooled from the melting temperature to a temperature below the glass transition temperature at a rate substantially less than about $10^5$ K/s, preferably less than $10^3$ K/s and often at much lower rates, most preferably less than 100 K/s.

It has been discovered that quinary or more complex alloys with titanium, zirconium (or hafnium), aluminum (or zinc), copper and nickel (or cobalt) form metallic glasses with much lower critical cooling rates than previously thought possible. A limited amount of iron may also be included as part of the copper and nickel portion. Quaternary alloys of such materials have not been found to make completely amorphous objects with a smallest dimension of at least one millimeter. Quinary alloys with critical cooling rates as low as about 10 K/s are found in practice of this invention.

Generally speaking, reasonable glass forming alloys are at least quinary alloys. Quaternary alloys have titanium, copper, at least one early transition metal selected from the group consisting of zirconium and hafnium and at least one late transition metal selected from the group consisting of nickel and cobalt. Quinary alloys have titanium and/or niobium, aluminum and/or zinc, zirconium and/or hafnium, copper and nickel and/or cobalt, and optionally, some iron. The glass forming alloys may also comprise up to 4% of other transition metals and a total of no more than 2% of other elements. (Unless indicated otherwise, composition percentages stated herein are atomic percentages.) The additional 2% may include beryllium, which tends to reduce the critical cooling rate, but it is preferred to avoid beryllium.

Broadly stated, the glass forming alloys of this invention include titanium and/or niobium in the range of 5 to 7.5 atomic percent, zirconium and/or hafnium in the range of 45 to 65 atomic percent, and aluminum and/or zinc in the range of 5 to 15 atomic percent. The balance may comprise copper, iron, and cobalt and/or nickel. Hafnium is essentially interchangeable with zirconium. Likewise, titanium is interchangeable with niobium and aluminum is interchangeable with zinc. Cobalt can be substituted for nickel and within limits iron can be included. The amount of iron should be no more than 10 atomic percent.

Preferably the titanium (or niobium) content is in excess of 5 atomic percent for best glass forming properties, and preferably the titanium is up to 6 atomic percent. The aluminum content is preferably less than about 12 atomic percent. There are certain preferred alloy ranges; for example, good glass forming compositions are formed when titanium is more than 5 atomic percent and zirconium is in the range of from 45 to 60 atomic percent. Another preferred composition has 5 to 7.5 atomic percent of niobium and from 50 to 65 atomic percent zirconium.

The general formula for good amorphous alloys is as follows:

$$(Zr,Hf)_a(Al,Zn)_b(Ti,Nb)_c(Cu_xFe_y(Ni,Co)_z)_d$$

The general formula is limited by the following constraints:

$45<a<65$ $5<b<15$ $5<c<7.5$ $d=100-(a+b+c)$ $dy<10$ $0.5<x/z<2$

In this formula a, b, c, and d are atomic percentages as measured relative to the molar weight of the entire compound. The variables x, y, and z are atomic fractions. In this composition a is in the range of from 45 to 65, b is in the range of from 5 to 15, c is in the range of from 5 to 7.5, subject to certain constraints, and d is the balance. The atomic fraction of copper, x, and the atomic fraction of nickel and/or cobalt, z, are constrained such that the ratio of x to z is in the range from 1:2 to 2:1. This constraint is presented by the formula $0.5<x/z<2$. The atomic fraction of iron is also constrained such that the product of the atomic fraction, y, and the atomic percentage, d, is less than 10; that is, $d \cdot y<10$.

In other words the ratio of copper to nickel is in the range of from 1:2 to 2:1. Preferably, for better glass forming alloys, the ratio of copper to nickel and/or cobalt is in the range of from 1:1 to 1.5:1. It appears that the best glass forming alloys have a copper to nickel ratio of about 1.2.

Preferably, zirconium, as opposed to hafnium, is used in the alloy composition since it is economical and provides the alloy with exceptional corrosion resistance and light weight. Titanium is preferred over niobium for similar reasons. Preferably, nickel, as opposed to cobalt, is used in the alloy composition since cobalt is somewhat more costly and lower critical cooling rates appear feasible with nickel than with cobalt. Aluminum is preferred over zinc since the latter has significant vapor pressure at processing temperatures and maintaining alloy compositions is more difficult than with aluminum.

The preferred alloy compositions within the glass forming region have a critical cooling rate for glass formation less than about $10^3$ K/s and some appear to have critical cooling rates as low as 10 K/s. The cooling rate is not well measured and may be, for example, $2\times10^3$ or below $10^3$. A cooling rate of $10^3$ is considered to be the order of magnitude of samples about 0.5 to 1 mm thick.

One example of a preferred alloy composition includes zirconium in the range of 52.5 to 57.5 atomic percent, 5 atomic percent of titanium and/or niobium, 7.5 to 12.5 atomic percent of aluminum and/or zinc, copper in the range of 15 to 19.3 atomic percent, and 11.6 to 16.4 atomic percent of nickel and/or cobalt. Other preferred alloy compositions can be represented by the following formulas:

$$Zr_{52.5}Ti_5(Al,Zn)_{10}Cu_{17.9}(Ni,Co)_{14.6},$$

$$Zr_{57}Nb_5(Al,Zn)_{10}Cu_{15.4}(Ni,Co)_{12.6}$$

and $$Zr_{56-58}Nb_5(Al,Zn)_{7.5-12}Cu_{13.8-17}(Ni,Co)_{11.2-14}.$$

Generally speaking, up to 4 atomic percent of other transition metals is acceptable in the glass alloy. It can also be noted that the glass forming alloy can tolerate appreciable amounts of several elements what could be considered incidental or contaminant materials. For example, an appreciable amount of oxygen may dissolve in the metallic glass without significantly shifting the crystallization curve. Other incidental elements, such as germanium, phosphorus, carbon or nitrogen may be present in total amounts less than about two atomic percent, and preferably in total amounts less than about one atomic percent.

Within these broad composition ranges, there may also be alloy combinations that do not have a sufficiently low cooling rate to form amorphous objects at least ½ or one millimeter thick as set forth in the various claims. Not all alloys within these ranges are claimed in this invention. The claims are only for an object having a smallest dimension of one millimeter which is at least 50% amorphous phase and having a composition within the recited ranges. If the object is not a metallic glass, it is not claimed.

When the object has a thickness of at least 1 mm in its smallest dimension, i.e., all dimensions of the object have a dimension of at least 1 mm., the cooling rate that can be achieved from the molten state through the glass transition temperature is no more than about $10^3$ K/s. Higher cooling rates can be achieved only in much thinner sections. If the thickness of the glassy object is appreciably more than 1 mm, the cooling rate is, of course, commensurately lower. Compositions which have lower critical cooling rates and can form glassy alloys in such thicker sections are within the ranges disclosed. For example, alloys have been made completely amorphous in bodies having a smallest dimension of about two millimeters.

With the variety of material combinations encompassed by the ranges described, there may be unusual mixtures of metals that do not form at least 50% glassy phase at cooling rates less than about $10^5$ K/s. Suitable combinations may be readily identified by the simple expedient of melting the alloy composition, splat quenching and verifying the amorphous nature of the sample. Preferred compositions are readily identified with lower critical cooling rates.

The amorphous nature of the metallic glasses can be verified by a number of well known methods such as X-ray diffraction, differential thermal analysis or transmission electron microscopy analysis.

The alloys provided in practice of this invention are particularly useful for forming composite materials where fibers or particles of other materials are embedded in a matrix of amorphous metal alloy. A great variety of particles and fibers are suitable for making such composites, including, for example, diamond, cubic boron nitride, refractory metal carbides (for example, tungsten carbide, boron carbide, silicon carbide), nitrides (for example, titanium nitride), carbonitrides (for example, titanium carbonitride, titanium oxycarbonitride), oxides (for example, silicon oxide, magnesium oxide, aluminum oxide) and silicides (for example, zirconium silicide $Zr_3Si_2$), silicon and other semiconductors, refractory metals (for example, tungsten, molybdenum, steel) and intermetallic compounds, pyrolytic carbon, graphite, boron, silica base glass, and natural or synthetic minerals (for example, silicates). The fibers or particles selected should, of course, not react with or dissolve in the metal alloy forming the amorphous phase.

It is found that the metallic glass alloys readily wet many materials and a composite material can be made by pressing particles at high pressure to form a self supporting body and infiltrating liquid alloy into the pores of the body. One may also make a felt or woven fabric of fibers and infiltrate liquid alloy into the felt or fabric. Alternatively, particles and/or fibers may be mixed with liquid alloy which is then cast into a desired shape.

With some of the particles or fibers, the thermal conductivity of the composite is greater than the thermal conductivity of the alloy alone. With such composites, the thickness of the body which can be amorphous is greater than the thickness of a body of the same alloy which can be amorphous with a given cooling rate.

EXAMPLES

Following is a table of alloys which can be cast in a strip at least one millimeter thick with more than 50% by volume amorphous phase. The alloy composition is determined by inputting the values listed in Table I into the formula stated above.

The values listed under each element correspond to a variable in the formula. For example, the values listed under Zr, zirconium, correspond to variable a in the general formula. Furthermore, under the heading "Comment", the method of cooling the alloy composition to obtain an amorphous sample is designated.

"D" represents creation of an amorphous composition by an injection mold die casting technique.

"A" represents creation of an amorphous composition by an arc melter technique.

"P" is indicative of creation of a partially amorphous composition by the arc melter technique. Partially amorphous samples are a product of uneven heating of the sample. Unless heated to a very high temperature, some of the alloy button in the arc melter is not completely melted. A thin layer next to the water cooled bottom of the arc melter remains unmelted. When the sample is cooled, these crystalline regions may grow away from the surface. If the cooling rate is near the critical cooling rate for glass forming, the crystals may grow through an appreciable thickness of the button. If the alloy is a good glass former so that the critical cooling rate is quite low, crystals will not grow an appreciable amount from the nucleated surface. Edges of a sample which are thinner and have a higher cooling rate may also remain amorphous.

TABLE I

| Atomic Percentages | | | | | | |
|---|---|---|---|---|---|---|
| Zr | Ti | Nb | Al | Cu | Ni | Comment |
| 45 | 7.5 | 5 | 7.5 | 19.5 | 15.5 | D |
| 50 | 7.5 | 5 | 7.5 | 16.5 | 13.5 | D |
| 55 | 7.5 | 5 | 7.5 | 13.5 | 11.5 | D |
| 47.5 | 5 | 5 | 7.5 | 19.5 | 15.5 | D |
| 52.5 | 5 | 5 | 7.5 | 16.5 | 13.5 | P |
| 57.5 | 5 | 5 | 7.5 | 13.5 | 11.5 | P |
| 50 | 4 | 3.5 | 7.5 | 19.5 | 15.5 | P |
| 55 | 4 | 3.5 | 7.5 | 16.5 | 13.5 | P |
| 60 | 4 | 3.5 | 7.5 | 13.5 | 11.5 | P |
| 50 | 0 | 7.5 | 7.5 | 19.5 | 15.5 | D |
| 55 | 0 | 7.5 | 7.5 | 16.5 | 13.5 | P |
| 60 | 0 | 7.5 | 7.5 | 13.5 | 11.5 | P |
| 45 | 0 | 7.5 | 7.5 | 20 | 20 | D |
| 45 | 0 | 5 | 7.5 | 23.5 | 19 | D |
| 50 | 0 | 5 | 7.5 | 20.5 | 17 | P |
| 55 | 0 | 5 | 7.5 | 18 | 14.5 | P |
| 60 | 0 | 5 | 7.5 | 15 | 12.5 | P |
| 45 | 0 | 10 | 7.5 | 20.5 | 17 | D |
| 50 | 0 | 10 | 7.5 | 18 | 14.5 | D |
| 55 | 0 | 10 | 7.5 | 15 | 12.5 | D |
| 52.5 | 0 | 7.5 | 7.5 | 14 | 18.5 | D |
| 57.5 | 0 | 7.5 | 7.5 | 12 | 15.5 | D |
| 45 | 0 | 7.5 | 5 | 23.5 | 19 | D |
| 50 | 0 | 7.5 | 5 | 20.5 | 17 | P |
| 55 | 0 | 7.5 | 5 | 18 | 14.5 | P |
| 60 | 0 | 7.5 | 5 | 15 | 12.5 | P |
| 45 | 0 | 7.5 | 10 | 20.5 | 17 | D |
| 50 | 0 | 7.5 | 10 | 18 | 14.5 | D |
| 55 | 0 | 7.5 | 10 | 15 | 12.5 | P |
| 60 | 0 | 7.5 | 10 | 12.5 | 10 | P |
| 52.5 | 0 | 5 | 7.5 | 19.25 | 15.75 | P |
| 52.5 | 0 | 3.5 | 7.5 | 20 | 16.5 | P |
| 57.5 | 0 | 5 | 7.5 | 16.5 | 13.5 | A |
| 57.5 | 0 | 3.5 | 7.5 | 17.5 | 14 | P |
| 57 | 0 | 5 | 8 | 16.5 | 13.5 | A |
| 57 | 0 | 5 | 8.5 | 16.2 | 13.3 | A |
| 57 | 0 | 5 | 10 | 15.4 | 12.6 | A |
| 56.5 | 0 | 5 | 7.5 | 17 | 14 | P |
| 56.5 | 0 | 5 | 8.5 | 16.5 | 13.5 | A |
| 57 | 0 | 5 | 11 | 14.9 | 12.1 | A |
| 52.5 | 0 | 5 | 12.5 | 16.5 | 13.5 | P |
| 55 | 0 | 5 | 12.5 | 15.1 | 12.4 | A |
| 57.5 | 0 | 5 | 12.5 | 13.8 | 11.2 | A |
| 60 | 0 | 5 | 12.5 | 12.4 | 10.1 | P |
| 52.5 | 0 | 5 | 15 | 15.1 | 12.4 | P |
| 55 | 0 | 5 | 15 | 13.8 | 11.2 | P |
| 57.5 | 0 | 5 | 15 | 12.4 | 10.1 | P |
| 60 | 0 | 5 | 15 | 11 | 9 | D |
| 50 | 0 | 7.5 | 7.5 | 17.5 | 17.5 | D |
| 55 | 0 | 7.5 | 7.5 | 15 | 15 | P |
| 50 | 0 | 7.5 | 7.5 | 15 | 20 | D |
| 55 | 0 | 7.5 | 7.5 | 13 | 17 | P |
| 52.5 | 0 | 5 | 8.5 | 14.6 | 19.4 | P |
| 55 | 0 | 5 | 8.5 | 13.5 | 18 | P |
| 57.5 | 0 | 5 | 8.5 | 12.4 | 16.6 | P |
| 52.5 | 0 | 5 | 8.5 | 20.4 | 13.6 | A |

TABLE I-continued

| Atomic Percentages | | | | | | |
|---|---|---|---|---|---|---|
| Zr | Ti | Nb | Al | Cu | Ni | Comment |
| 55 | 0 | 5 | 8.5 | 18.9 | 12.6 | A |
| 57.5 | 0 | 5 | 8.5 | 17.4 | 11.6 | A |
| 60 | 0 | 5 | 8.5 | 15.9 | 10.6 | P |
| 55 | 0 | 5 | 8.5 | 18 | 12 | A |
| 57.5 | 0 | 5 | 10 | 16.5 | 11 | A |
| 54 | 0 | 5 | 10 | 18.6 | 12.4 | A |
| 56 | 0 | 5 | 10 | 17.4 | 11.6 | A |
| 52.5 | 0 | 5 | 12.5 | 18 | 12 | P |
| 55 | 0 | 5 | 12.5 | 16.5 | 11 | A |
| 57.5 | 0 | 5 | 12.5 | 15 | 10 | A |
| 52.5 | 0 | 7.5 | 10 | 16.5 | 13.5 | P |
| 57.5 | 0 | 7.5 | 10 | 13.75 | 11.25 | P |
| 52.5 | 0 | 2.5 | 10 | 19.25 | 15.75 | D |
| 55 | 0 | 2.5 | 10 | 17.9 | 14.6 | D |
| 57.5 | 0 | 2.5 | 10 | 16.5 | 13.5 | D |
| 60 | 0 | 2.5 | 10 | 15.1 | 12.4 | D |
| 52.5 | 5 | 0 | 7.5 | 19.3 | 15.7 | P |
| 55 | 5 | 0 | 7.5 | 17.9 | 16.4 | A |
| 57.5 | 5 | 0 | 7.5 | 16.5 | 13.5 | A |
| 52.5 | 5 | 0 | 10 | 17.9 | 14.6 | A |
| 55 | 5 | 0 | 10 | 16.5 | 13.5 | A |
| 57.5 | 5 | 0 | 10 | 15.1 | 12.4 | P |
| 50 | 5 | 0 | 10 | 19.3 | 15.7 | P |
| 45 | 9 | 0 | 6 | 30 | 10 | D |
| 50 | 9 | 0 | 6 | 20 | 15 | P |
| 55 | 9 | 0 | 6 | 15 | 15 | P |
| 60 | 9 | 0 | 6 | 10 | 15 | P |
| 45 | 12 | 0 | 8 | 20 | 15 | D |
| 50 | 12 | 0 | 8 | 15 | 15 | D |
| 55 | 12 | 0 | 8 | 10 | 15 | D |
| 45 | 5 | 0 | 5 | 37 | 8 | D |
| 50 | 5 | 0 | 5 | 30 | 10 | D |
| 55 | 5 | 0 | 5 | 20 | 15 | P |
| 60 | 5 | 0 | 5 | 15 | 15 | P |
| 65 | 5 | 0 | 5 | 10 | 15 | P |
| 45 | 7.5 | 0 | 7.5 | 30 | 10 | D |
| 50 | 7.5 | 0 | 7.5 | 20 | 15 | P |
| 55 | 7.5 | 0 | 7.5 | 15 | 15 | P |
| 60 | 7.5 | 0 | 7.5 | 10 | 15 | P |
| 45 | 10 | 0 | 10 | 20 | 15 | D |
| 50 | 10 | 0 | 10 | 15 | 15 | D |
| 55 | 10 | 0 | 10 | 10 | 15 | P |
| 60 | 10 | 0 | 10 | 10 | 10 | D |
| 45 | 6 | 0 | 9 | 30 | 10 | P |
| 50 | 6 | 0 | 9 | 20 | 15 | P |
| 55 | 6 | 0 | 9 | 15 | 15 | P |
| 60 | 6 | 0 | 9 | 10 | 15 | D |
| 45 | 8 | 0 | 12 | 20 | 15 | D |
| 50 | 8 | 0 | 12 | 15 | 15 | P |
| 55 | 8 | 0 | 12 | 10 | 15 | P |
| 45 | 4.5 | 0 | 10.5 | 30 | 10 | D |
| 50 | 4.5 | 0 | 10.5 | 20 | 15 | P |
| 55 | 4.5 | 0 | 10.5 | 15 | 15 | P |
| 60 | 4.5 | 0 | 10.5 | 10 | 15 | P |
| 40 | 6 | 0 | 14 | 30 | 10 | D |
| 45 | 6 | 0 | 14 | 20 | 15 | D |
| 50 | 6 | 0 | 14 | 15 | 15 | P |
| 55 | 6 | 0 | 14 | 10 | 15 | P |
| 55 | 7.5 | 0 | 7.5 | 20 | 10 | P |
| 55 | 7.5 | 0 | 7.5 | 10 | 20 | P |
| 55 | 7.5 | 0 | 7.5 | 17 | 13 | P |
| 57.5 | 7.5 | 0 | 7.5 | 15.1 | 12.4 | P |
| 60 | 7.5 | 0 | 7.5 | 13.8 | 11.2 | P |

A number of categories and specific examples of glass-forming alloy compositions having low critical cooling rates are described herein. It will apparent to those skilled in the art that the boundaries of the glass-forming regions described are approximate and that compositions somewhat outside these precise boundaries may be good glass-forming materials and compositions slightly inside these boundaries may not be glass-forming materials at cooling rates less than 1000 K/s. Thus, within the scope of the following claims, this invention may be practiced with some variation from the precise compositions described.

What is claimed is:

1. A metallic glass object having a thickness of at least one millimeter in its smallest dimension formed of an alloy comprising at least five elements including:

zirconium in the range of from 45 to 65 atomic percent;

from 5 to 15 atomic percent of zinc;

from 4 to 7.5 atomic percent of metal selected from the group consisting of titanium and niobium;

a balance substantially of metal selected from the group consisting of copper, nickel, cobalt and up to 10 atomic percent iron wherein the ratio of copper to the sum of nickel and cobalt is in the range of from 1:2 to 2:1.

2. A metallic glass object according to claim 1 wherein the ratio of copper to the sum of nickel and cobalt is in the range of from 1:1 to 1.5:1.

3. A metallic glass object according to claim 1 wherein the ratio of copper to the sum of nickel and cobalt is about 1.2.

4. A metallic glass object according to claim 1 wherein the content of titanium and/or niobium is greater than 5 atomic percent.

5. A metallic glass object according to claim 1 wherein the content of titanium and/or niobium is in the range of from 5 to 6 atomic percent.

6. A metallic glass object according to claim 1 wherein the content of zinc is in the range of from 5 to 12 atomic percent.

7. A metallic glass object according to claim 1 comprising titanium in the range of from 5 to 7.5 atomic percent and wherein the zirconium is in the range of from 45 to 60 atomic percent.

8. A metallic glass object according to claim 7 wherein the zirconium is in the range of from 50 to 60 atomic percent.

9. A metallic glass object according to claim 1 comprising niobium in the range of from 4 to 7.5 atomic percent and wherein the zirconium is in the range of from 50 to 65 atomic percent.

10. A metallic glass object according to claim 9 wherein the zirconium is in the range of from 55 to 65 atomic percent.

11. A metallic glass object having a thickness of at least one millimeter in its smallest dimension formed of an alloy comprising:

zirconium in the range of from about 52.5 to 57.5 atomic percent;

about 5 atomic percent of metal selected from the group consisting of titanium and niobium;

from about 7.5 to 12.5 atomic percent of zinc;

copper in the range of from about 15 to 19.3 atomic percent; and a metal selected from the group consisting of nickel and cobalt in the range of from about 11.6 to 16.4 atomic percent.

12. A metallic glass object according to claim 11 formed of an alloy comprising:

about 52.5 atomic percent zirconium;

about 5 atomic percent titanium;

about 10 atomic percent of zinc;

about 17.9 atomic percent copper; and about 14.6 atomic percent of metal selected from the group consisting of nickel and cobalt.

13. A metallic glass object according to claim 12 comprising about 14.6 atomic percent nickel.

14. A metallic glass object having a thickness of at least one millimeter in its smallest dimension formed of an alloy comprising:

zirconium in the range of from about 56 to 58 atomic percent;

about 5 atomic percent niobium;

zinc in the range of from about 7.5 to 12.5 atomic percent;

copper in the range of from about 13.8 to 17 atomic percent; and a metal selected from the group consisting of nickel and cobalt in the range of from about 11.2 to 14 atomic percent.

15. A metallic glass object according to claim 14 formed of an alloy comprising:

about 57 atomic percent zirconium;

about 5 atomic percent niobium;

about 10 atomic percent of zinc;

about 15.4 atomic percent copper; and about 12.6 atomic percent of metal selected from the group consisting of nickel and cobalt.

16. A metallic glass object according to claim 14 comprising about 13.3 atomic percent nickel.

17. A composite material comprising:

particles or fibers of material selected from the group consisting of diamond, cubic boron nitride, refractory metal carbides, nitrides, carbonitrides, oxides and silicides, silicon, refractory metals and intermetallic compounds, pyrolytic carbon, graphite, boron, and silica base glass; and a matrix for the particles or fibers comprising a metallic glass formed of an alloy comprising at least five elements including:

zirconium in the range of from 45 to 65 atomic percent;

from 5 to 15 atomic percent of zinc;

from 4 to 7.5 atomic percent of metal selected from the group consisting of titanium and niobium; and a balance substantially of metal selected from the group consisting of copper, nickel, cobalt and up to 10 atomic percent iron wherein the ratio of copper to the sum of nickel and cobalt is in the range of from 1:2 to 2:1.

* * * * *